United States Patent [19]

Fanti

[11] 4,136,411

[45] Jan. 30, 1979

[54] FURNITURE FRAME

[75] Inventor: Hansruedi Fanti, Flüh, Switzerland

[73] Assignee: Matra AG, Switzerland

[21] Appl. No.: 844,061

[22] Filed: Oct. 20, 1977

[30] Foreign Application Priority Data

Oct. 22, 1976 [CH] Switzerland ..... 13375/76

[51] Int. Cl.[2] ..... A47C 23/06

[52] U.S. Cl. ..... 5/191; 5/238

[58] Field of Search ..... 5/191, 236–238; 297/283

[56] References Cited

U.S. PATENT DOCUMENTS 3,813,713 6/1974 Kipfer ..... 5/191

3,842,452 10/1974 Kievits ..... 5/191

FOREIGN PATENT DOCUMENTS 2254986 11/1972 Fed. Rep. of Germany ..... 5/191

*Primary Examiner*—Casmir A. Nunberg

*Attorney, Agent, or Firm*—McGlew and Tuttle

[57] ABSTRACT

A furniture frame comprises spaced carrier members each provided with a plurality of recesses, retaining members each having a recess engaging portion located in a respective one of the recesses, cross-battens each extending between a respective pair of the retaining members, and a respective elastic member detachably retained by each of the retaining members. Each retaining member comprises a bearing portion having two opposite sides, one of the opposite sides bearing against a respective one of the carrier members, and two side portions and at least one base portion at the other one of the opposite sides of the bearing portion. The elastic member is retained by the two side portions, at least one base portion and at least part of the bearing portion.

17 Claims, 11 Drawing Figures

FURNITURE FRAME

BACKGROUND OF THE INVENTION

The present invention relates to a furniture frame and particularly but not exclusively to a reclining furniture frame.

Swiss Patent Specification No. 513,624 discloses a reclining furniture frame comprising recessed carriers and cross-battens and in which a mounting consisting of a rigid material is inserted into each recess. The mounting comprises four limbs which together constitute a rectangular frame completely disposed in the interior of the recess. The cross-sectional dimensions of the opening formed by the frame are greater than those of the cross-battens. At least one elestically deformable element is arranged between one of the longer frame limbs and the cross-batten projecting into the frame opening.

With this known reclining furniture frame, sprung movements in the vertical direction as well as pivotal movements of the cross-battens are possible. Since the resilient elements have, however, only a relatively small dimension in the vertical direction and the cross-battens bear directly on the resilient elements, the cross-battens can execute only short movements. Nevertheless, the cross-sectional dimensions of the recesses, especially their height, must inevitably be substantially greater than those of the cross-battens. So that the longitudinal carriers are not excessively weakened by these large recesses, they must, therefore, have a greater minimum thickness measured in the vertical direction than longitudinal carriers in which the cross-battens sit in the recess in known manner without springing. This results in an increase in costs in many cases. For example, in reclining furniture frames pivotable batten gratings are frequently used, in which a part of the cross-battens is held in pivotable struts which make it possible to raise the head and/or the feet of a lying person. These pivotable struts are formed from strips, which are as thin and light as possible to keep the costs and also the weight of the pivotable grating as low as possible. In such reclining furniture frames with pivotable gratings, the aforementioned required increase in the minimum thickness measured in the vertical direction acts particularly disadvantageously.

Swiss Patent Specification No. 388,561 discloses a reclining furniture frame, in which each cross-batten is carried at each end by a rubber-elastic support which is fastened to the inside of a longitudinal carrier. Each elastic support is fastened by means of two spigots which penetrate it underneath the cross-batten. The upper part of the eleastic support is formed to be T-shaped and each cross-batten is provided at its opposite ends with a longitudinal slot so that the end of the batten can be plugged onto the vertical web of the T-shaped upper part. This known reclining furniture frame has the disadvantage that relatively large shear forces can arise in the rubber-elastic support, especially in the region of the spigots carrying it, so that there is a danger that the support may be sheared off or that tears may arise in it. A further disadvantage is that the cross-battens must be provided at their ends with slots, which increases the manufacturing costs. The supports must have a certain minimum height so that good springing results, but the cross-battens must be disposed a little underneath the upper edges of the longitudinal carriers so that the mattress bears not only on the cross-battens, but also by its longitudinal edges on the longitudinal carriers. This requirement stipulates that the height of the longitudinal carriers is at least equal to the height of the rubber-elastic supports. In the case of the pivotably fastened struts, which are customarily used for the non-springing fastening, the height is, however, only just sufficient to ensure there is adequate wall thickness at the recesses. Thus, for this known resilient manner of fastening, too, struts with a larger cross-section must be used than in the case of a non-resilient fastening.

In both the aforementioned known reclining furniture frames, it is not possible to use the same longitudinal carriers for the manufacture of reclining furniture frames with resilient cross-batten mounting as for the manufacture of cheaper constructions in which the cross-battens are plugged directly into the recesses without resilient mounting. Thus, two kinds of longitudinal carriers must be produced and stored, namely those with recesses for the cheaper construction with non-resilient fastenings of the cross-battens and those with other recesses for the more expensive construction with resilient cross-batten fastenings.

The delivery program of a manufacturer normally also comprises other types apart from the resilient and non-resilient cross-batten fastenings. For example, the cross-battens in certain reclining furniture are fastened in the side cheeks, which are immovably connected with the remaining parts of the frame. In other types, the cross-battens are, as already mentioned, held in struts, which are pivotably connected with a fixed frame part of the frame and which make it possible to raise and bear high the head and/or feet of a lying person. In case a variant with resilient and a variant with non-resilient cross-batten fastenings is provided for each of these types of fabrication, an appreciable increase of the fabrication and storage costs results.

An object of the present invention is to create a reclining furniture frame with resilient cross-batten fastening, which makes it possible to avoid the disadvantages of the known constructions.

SUMMARY OF THE INVENTION

According to the present invention, there is provided a furniture frame comprising:

(a) spaced carrier members each provised with a plurality of recesses, (b) a plurality of retaining members each having a recess engaging portion located in a respective one of the recesses, (c) a plurality of cross-battens each extending between a respective pair of the retaining members, and (d) a respective elastic member detachably retained by each of the retaining members, wherein each retaining member comprises a bearing portion having two opposite sides, one of the opposite sides bearing against a respective one of the carrier members, and two side portions and at least one base portion at the other one of the opposite sides of said bearing portion, the elastic member being retained by the two side portions, at least one base portion and at least part of the bearing portion.

Preferably the portions retaining the elastic member and the bottom portion or portions as well as preferably back portions are arranged underneath the recess engaging portion. The latter is expediently constructed in such a manner that it is pluggable into a recess of a carrier, into which a cross-batten could also be plugged in directly. This makes it possible for the manufacture of a furniture frame to use like carriers and cross-battens with the same cross-sectional dimensions as for the manufacture of reclining furniture frames with non-resilient cross-batten fastening and then to hold the cross-battens in both cases in the proximity of the upper edges of the carriers.

BRIEF DESCRIPTION OF THE DRAWINGS

Embodiments of the present invention will now be more particularly described by way of example with reference to the accompanying drawings in which.

DESCRIPTION OF THE PREFERRED EMBODIMENT

Figure 1:
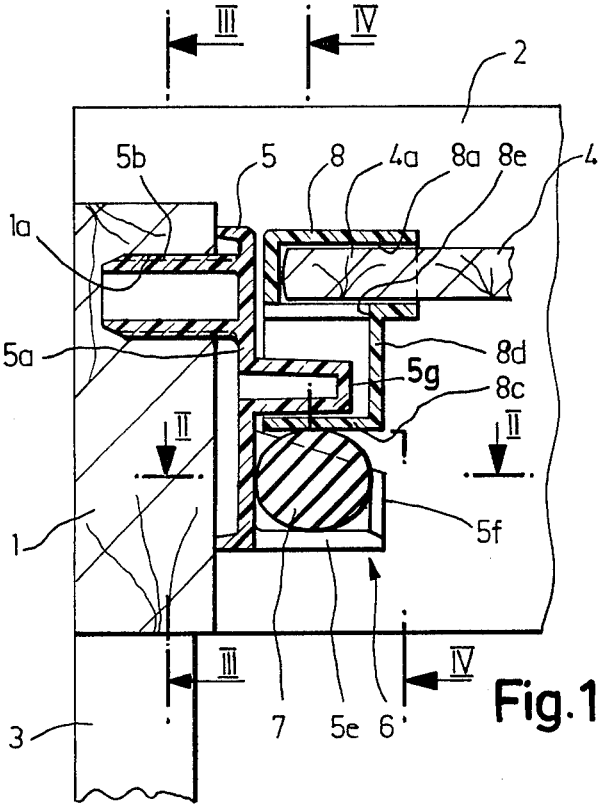
FIG. 1 shows a cross-sectional view through part of a furniture frame.

Referring to the drawing, FIG. 1 shows a detail of a reclining furniture frame, a so-called Lättli couch, which at both sides has a longitudinal carrier 1 of wood, only one carrier being visible. The longitudinal carriers 1 form the fixed side cheeks of the reclining furniture frame and are connected fast with one another through at least two cross-beams (not shown). Respective boards are 2 are fastened at the head and foot ends of the longitudinal carriers 1. Furthermore, feet 3 or skids are fastened to the longitudinal carriers 1 or the cross-beams. Fastened between the two longitudinal carriers are cross-battens 4 comprising several layers of wood of which only one is visible.

Figure 3:
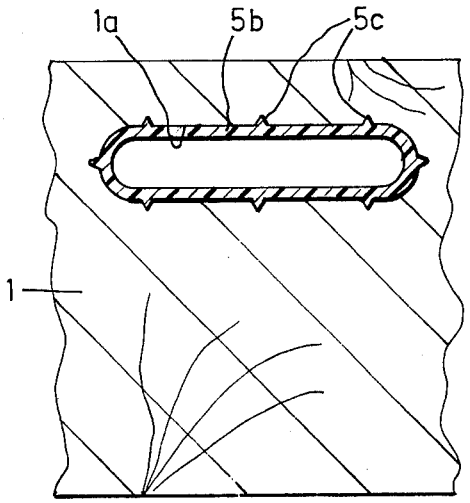
FIG. 3 shows a section along the line III—III of FIG. 1.
Figure 4:
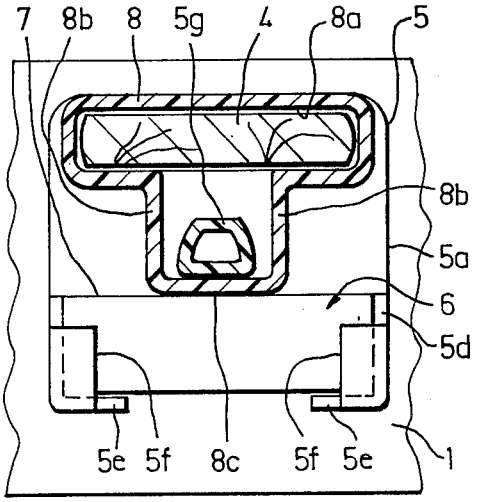
FIG. 4 shows a section along the line IV—IV of FIG. 1.

Each longitudinal carrier 1 has, for each cross-batten, a recess 1*a*, the cross-section of which is shown in FIG. 3. The recess 1*a* is bounded above and below by horizontal ceiling and bottom surfaces, respectively, and to both sides by an arcuate side surface. The cross-sectional dimensions of the recess 1*a* are, as shown in FIG. 4, somewhat larger than the cross-sectional dimensions of the end 4*a* of the cross-batten 4, and the vertical cross-sectional dimension of the cross-batten ends 4*a* can be somewhat smaller than that of the middle part of the cross-battens. The dimension of the recess 1*a* measured in the horizontal direction is for example 10 to 20% greater than the width of the cross-batten 4. The height of the recess is about 20 to 60% greater than the maximum height of the cross-batten 4, i.e. than the height of the middle part of the cross-batten 4.

Figure 2:
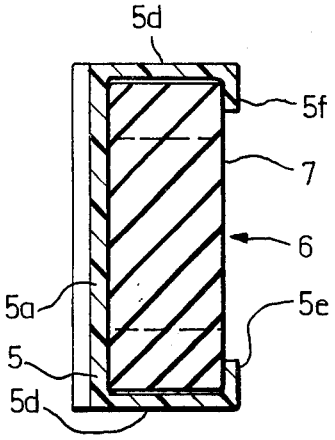
FIG. 2 shows a section along the line II—II of FIG. 1.

The cross-battens 4 are resiliently connected at both ends 4*a* with the longitudinal carriers 1 by means of a holder 5. The retaining member 5 comprises a unitary body of a hard, rigidly cross-linked, i.e. non-rubber elastic synthetic material and has a vertical, plate-shaped bearing portion 5*a*, the edges of which protrude towards the longitudinal carrier 1 and bear against the vertical longitudinal surface thereof. The retaining member or holder has a recess engaging portion 5*b* in the proximity of the upper edge of the bearing portion 5*a*. This has the shape of a hollow elongate spigot, the outline of which is, as shown in FIG. 3, complementary to that of the recess 1*a*. The recess engaging portion 5*b* can therefore be plugged into the recess 1*a* so that it sits releasably fast therein. The recess engaging portion is additionally provided with the ribs 5*c*, which, on insertion, are pressed somewhat into the wood of the longitudinal carrier 1 and additionally fix the recess engaging portion. Below the recess engaging portion 5*b*, at the lower end of the bearing portion 5*a*, a respective vertical side portion 5*d* is present on the side of the bearing portion 5*a* remote from the recess engaging portion 5*b* at the two vertical edges of the bearing portion 5*a*. The two side portions 5*d*, as clearly shown in FIGS. 2 and 4, are arranged symmetrically with respect to the vertical longitudinal center plane of the cross-batten 4 and are each disposed somewhat outside the side edges of the cross-batten on opposite sided of the cross-batten. The spacing of the side portions is thus greater than the width of the cross-batten 4. A base portion 5*e*, which is flush with the lower edge of the bearing portion 5*a* and contiguous with the bearing portion 5*a* and the adjacent side portion 5*d*, is present below each side portion 5*d*. Two back portions 5*f* extend parallel to the bearing portion 5*a* and are each contiguous with the respective adjacent side and bottom portions. A gap is present between the two side portions and back portions, respectively.

The bearing portion 5*a* together with one side portion 5*b*, base portion 5*e* and back portion each 5*f* forms a compartment. The two compartments are open towards each other and together form a container 6 open upwardly over its entire length. Disposed in this is an elastic support member 7, which is formed by a rubber-elastic, approximately circularly cylindrical profile body with a horizontal longitudinal axis and which is symmetrical with respect to the vertical longitudinal center plane of the cross-batten. The length and width of the member 7 is so dimensioned that it sits fast, but downwardly deformable in the center, in the container 6. The rubber-elastic member could also have another cross-section such as a square or approximately a square. Furthermore, the container need not necessarily be upwardly open over its entire length, but only in the bearing part, as is the case in the embodiment shown in FIGS. 6 and 7.

Somewhat above the container 6 and the member 7, but on the same side of the bearing portion 5*a* as these, the retaining member is provided with a lug 5*g*, which is visible in FIGS. 1 and 4. Furthermore, a sleeve 8 of a hard, rigidly cross-linked, i.e. non rubber-elastic synthetic material with an opening 8*a* is present, in which the end 4*a* of the cross-batten 4 sits with some play. The cross-sectional dimensions of the opening 8a are somewhat smaller than the corresponding outline dimensions of the recess 1a. The opening of the sleeve 8 is preferably closed off by a back wall at its end facing the holder bearing portion 5a. At its lower side, the sleeve 8 is provided with two limbs 8b, which at their lower ends are connected with one another by a web 8c. Furthermore, the limbs 8b are connected with one another by a back portion 8d at their edges remote from the bearing portion of the retaining member 5a. The limbs 8b, the web 8c and the back portion 8d thus together form a shell open towards the bearing portion 5a. The bottom of the sleeve 8 is provided with an indentation 8e in the region of this shell, i.e. between the limbs 8b, so that the space region bounded by the shell is contiguous with the opening 8a.

As is shown in FIG. 4, the limbs 8b together with the web 8c connecting them encompass the lug 5g of the retaining member 5. The height and width of the gap bounded by the limbs and the web are a few millimeters greater than the corresponding dimensions of the lug. The web 8c bears against the middle of the elastic member 7 and deforms this a little.

To assemble the frame an elastic member 7 is inserted into the container 6 of each retaining member 5. Subsequently, a retaining member 5 is plugged into each recess 1a. A sleeve 8 can now be placed onto each retaining member 5. The web 8c is situated between the lug 5g and the rubber-elastic member 7 and is clamped in this position, whereby the entire sleeve 8 is held fast. Finally, the two ends 4a of the cross-battens 4 are inserted into one pair of mutually opposite sleeves 8. To effect introduction, the cross-battens, which are elastic, are bent a little. With this, the assembly of the reclining furniture frame is completed.

The rubber-elastic members 7 can be severed from a profile rod with a simple round profile. Its manufacture therefore requires only a small labor effort and relatively little material.

Each cross-batten 4 is now resiliently connected at both ends with a longitudinal carrier 1. The sleeve 8 can be pressed downwardly along the lug 5g, with the result that the central region of the rubber-elastic member 7 is bent downwardly. Of course, the sleeve 8 can also be pivoted around the lug 5g. The cross-batten 4 is disposed approximately at the same height as the recess 1a so that the cross-section of the cross-batten and the recess overlap. Since the elastic member 7, at its outer ends, is held underneath and on all sides, there is little danger that the support is sheared off even in the case of great loading and movements of the cross-battens 4 carried by it.

Figure 5:
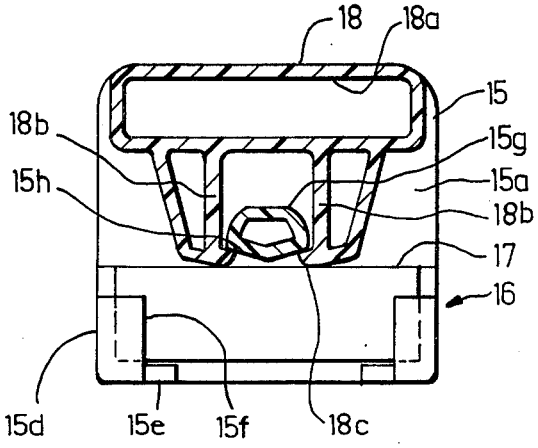
FIG. 5 shows a section, corresponding to FIG. 4, through a variant of a retaining member and a sleeve.

The retaining member 15 shown in FIG. 5 is substantially similarly to the retaining member 5. In particular, it has the same bearing portion 15a, a not visible recess engaging portion corresponding to the portion 5b, two side portions 15d, base portions 15e and back portions 15f, which form a container 16 for a rubber-elastic member 17. Above the container 16, it also has a lug 15g, the shape of which however differs somewhat from that of lug 5g. The side surfaces of the lug 15g together with its lower surfaces form respective sharp-edged sections 15h. A sleeve 18 of a hard synthetic material has an opening 18a to receive the cross-battens and two limbs 18b, each of which is formed by two webs, between which a gap is present. Each of the limbs 18b is provided at its lower free end with a projection 18c facing the other limb. These projections 18c engage behind the sections 15h. The limbs 18b are somewhat elastic, but not rubber-elastic, so that they can be pushed over the lug from above, for which they splay somewhat initially and then snap in to partially encompass the lug 15g. The construction of the retaining member 15 and the sleeves 18 therefore makes it possible, during the assembly, at first to plug the cross-battens into the sleeves 18 and subsequently to push the latter from above into the holders 15.

Figure 6:
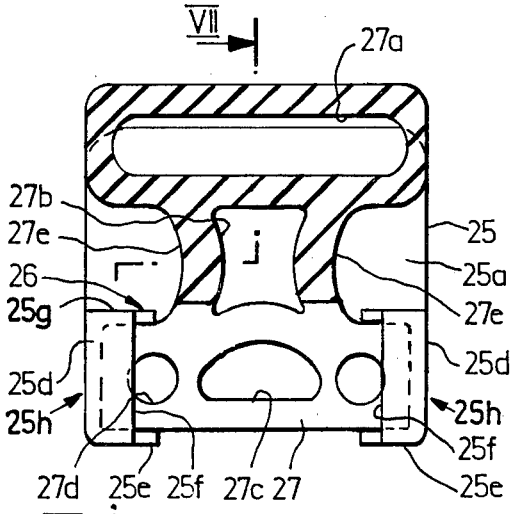
FIG. 6 shows a section, corresponding to FIG. 4, along the line VI—VI of FIG. 7 through a retaining member with a rubber-elastic member which has an opening to receive a cross-batten.
Figure 7:
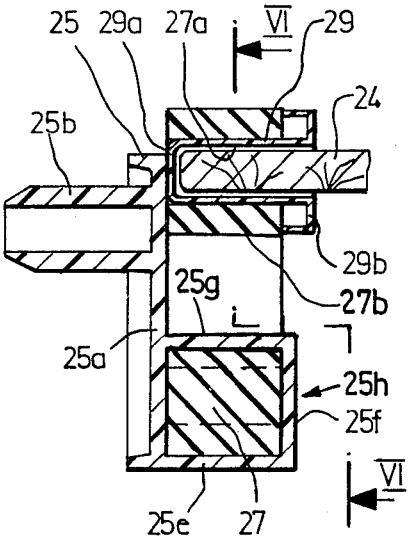
FIG. 7 shows a section along the line VII—VII of FIG. 6, with a sleeve of synthetic material and a cross-batten plugged into the opening of the elastic member.

FIGS. 6 and 7 show a holder 25 with a bearing portion 25a and a recess engaging portion 25b as well as respective pairs of side portions 25d, base portions 25e and back portions 25f. Each side portion 25b and each associated base portion 25e are contiguous with one another and with the substantially plate-shaped vertical bearing portion 25a. Each back portion 25f is contiguous with the associated side portion and base portion. The side portions and base portions are closed off at their upper ends by lid portions 25g of approximately the same dimensions as the base portion 25e. The four last-mentioned portions form, together with the bearing portion 25a a container 26, which is not upwardly open over its entire length, but only in the central region. The container 26 is thus formed by two container-like sections 25h of the retaining member 25, which are open only on the sides facing one another. The retaining member 25 differs from the retaining member 5 in that it has no lug corresponding to the lug 5g. The bearing portion 25a is thus completely planar above the container 26 on its side remote from the recess engaging portion 25b. Held in the container 26 is a rubber-elastic support member 27, which projects into the container-like sections 25h. The member 27 is, however, substantially higher than the members 7 and 17 and extends beyond the upper edge of the retaining member 25. The member 27, in the proximity of its upper end, has a passage opening 27a with an elongate cross-section. The cross-sectional dimensions of the passage opening are approximately the same or somewhat larger than those of the cross-batten 24 shown only in FIG. 7. The two side portions 25d are again disposed on opposite sides of the vertical longitudinal center plane of the cross-battens 24 and their spacing is greater than the width of the latter. The side portions and the elastic member are symmentrical with respect to the longitudinal center plane of the cross-batten.

The member 27 has still further passage openings 27b, 27c and 27d.

The openings 27b and 27c are disposed in the vertical plane of symmetry of the elastic member, the opening 27b being below the opening 27a and approximately in the central region of the elastic member, and the opening 27c being in the region of the container 26. The two openings 27d likewise are disposed in the region of the container 26 to both sides of the opening 27c. At the height of the opening 27b, the member 27 is provided at both sides with a cavity 27e, the depth of which is matched to the length of the lid portions 25g so that the lower region of the member 27 has two projections pluggable into the container-like sections 25h. A thin-walled sleeve 29, shown only in FIG. 7, having a rear wall 29a and an edge 29b, which bears on the outer surface of the member 27, is plugged into the opening 27a. The sleeve 29 consists of a rigidly cross-linked, wear-resistant synthetic material, for example polyethylene. Its cross-sectional dimensions are somewhat larger than those of the opening 27a so that the sections of the rubber-elastic member 27 bounding the opening 27*a* are somewhat stretched during the insertion of the sleeve 29 and the sleeve afterwards sits fast in the opening. The end of the cross-batten 24 in its turn then plugs with some play in the sleeve 29.

The openings 27*b*, 27*c* and 27*d* and the cavities 27*e* ensure a very good deformability of the member 27 so that fastening by means of the member 27 results in a large movability and very soft springing. Since the lower region of the elastic member is held below and to all sides at both ends, there is little danger that the supports will be sheared off even with large loadings and movements of the cross-battens. The manufacture of the embodiment shown in FIGS. 6 and 7 is, however, somewhat more expensive because of the relatively large amount of rubber-elastic material required compared with the embodiment shown in FIGS. 1 to 5.

The members 27 can be severed from an appropriate rubber-elastic profile rod during their manufacture. The sleeves 29 can of course also be omitted. In this case, the cross-sectional dimensions of the opening 27*a* would have to be made somewhat smaller than those of the cross-batten 24 so that the latter sits fast in the rubber-elastic member.

Figure 8:
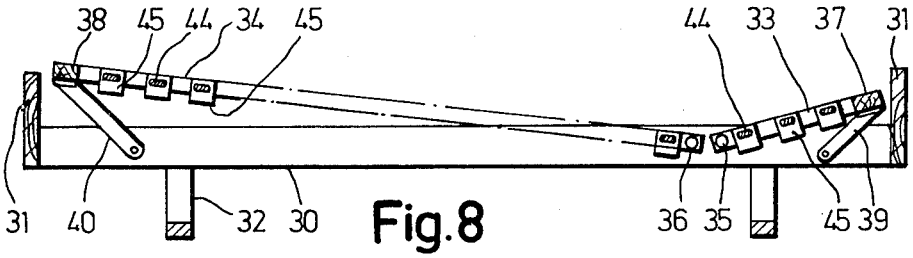
FIG. 8 shows a longitudinal section through a furniture frame having means to raise and lower the head and feet of a person.

FIG. 8 shows a reclining furniture frame with side cheeks 30, to which boards 31 are fastened at the head end and foot end, respectively. Skids 32 are fastened to the side cheeks or the cross-beams (not shown). Furthermore, two pairs of longitudinal carriers 33 and 34, namely two shorter struts and two longer struts, are pivotably fastened, by means of pivot bearings 35 and 36, respectively, to the side cheeks 30. The two longitudinal carriers 33 are connected fast with one at their ends remote from the pivot bearings 35 by a strip 37 and the longitudinal carriers 34, at their end remote from the pivot bearings 36 by a strip 38. Furthermore, supports 39 and 40, which are illustrated in simplified manner and which are pivotable and notchable in different settings, are present to locate the two pairs of struts in different settings of inclination. The longitudinal carriers 33 and 34 are provided with recesses, the shape and dimension of which agree with the shape and dimension of the recess 1*a* of the longitudinal carrier 1. Retaining members 45 are plugged into the recesses. Their construction can correspond to one of the described kinds of retaining members 5, 15 or 25. Cross-battens 44 can be resiliently connected with the longitudinal carriers 33 and 34 through the retaining members 45 and rubber-elastic supports (not shown). The depth, i.e. the vertical cross-sectional dimension of the longitudinal carriers 33 and 34 amounts to about 2 to 3 times the vertical dimension of the recesses present in the longitudinal carriers. The depth of the pivotable longitudinal carriers 33 and 34 can thus be relatively small so that only a small quantity of material is required for their manufacture. The retaining members 45 project beyond the longitudinal carriers on the lower side, but the cross-battens 44 are held, in spite of the small depth of the longitudinal carriers 33 and 34, in such a manner that they are disposed a little below the upper edges of the longitudinal carriers 33 and 34. A mattress can therefore bear not only on the cross-battens, but also with its longitudinal edges on the longitudinal carriers 33 and 34.

The pivotable longitudinal carriers 33 make it possible to raise the upper part of a lying person. The two longitudinal carriers 34 make it possible to raise the rump and the feet of the lying person.

It is thus possible to resiliently fasten cross-battens to fixed or pivotable longitudinal carriers by means of the same kind of retaining members and rubber-elastic members.

Figure 9:
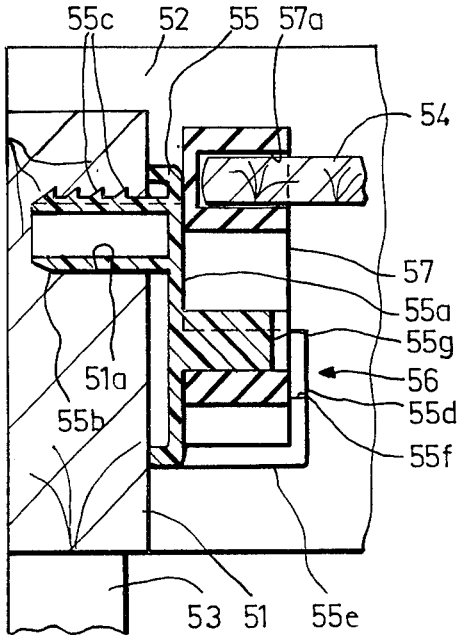
FIG. 9 shows a section through a part of another variant of a furniture frame.

The section of a reclining furniture frame shown in FIG. 9, has a longitudinal carrier 51 of wood at both sides. The longitudinal carriers 51 are connected with one another by boards 52 at the head and the foot ends. Furthermore, feet 53 are fastened to the longitudinal carriers. Each longitudinal carrier 51 has, for each cross-batten 54, a respective recess 51*a*, the cross-sectional dimensions of which are somewhat larger than the cross-sectional dimensions of the end of the cross-batten 54. The cross-battens 54 are resiliently connected with the longitudinal carriers 51 at both ends by means of a retaining member 55 and a rubber-elastic member 57. The retaining member 55 is of unitary construction and comprises rigidly cross-linked, i.e. not rubber-elastic, but somewhat elastically deformable synthetic material. The retaining member has a vertical, plate-shaped bearing portion 55*a*, which is substantially planar but provided with edges projecting towards the longitudinal carrier 51 and bearing against the vertical longitudinal surface thereof. A recess engaging portion 55*b* is present somewhat below the upper edge of the bearing portion 55. This has the shape of a hollow elongate spigot and is so dimensioned that it is pluggable into the recess 51*a*. The portion 55*b* is provided on its upper side with ribs, which have barb-like prongs 55*c* to ensure firm anchoring in the longitudinal carrier 51. Respective side portions 55*d* are present beneath the recess engaging portion 55*b*, i.e. at the lower end of the bearing portion 55*a* on the side thereof remote from the recess engaging portion 55*b*. The two side portions are arranged on opposite sides of the vertical longitudinal center plane of the cross-batten 54 and symmetrical with respect to this longitudinal center plane. Their spacing is at least equal to the width of the cross-batten. A base portion 55*e*, which is contiguous with the bearing portion 55*a* and the side portion and which is flush with the lower edge of the bearing portion 55, is present on each side portion 55*d*. Furthermore, two back portions 55*f* are present which are parallel to the bearing portion 55*a* and each of these is contiguous with a base portion and a side portion. A compartment, which is formed by the bearing portion and the respective associated side portion, base portion and back portion, is thus present at each of the lower corners of the bearing portion 55*a* on the side thereof remote from the recess engaging portion.

Figure 10:
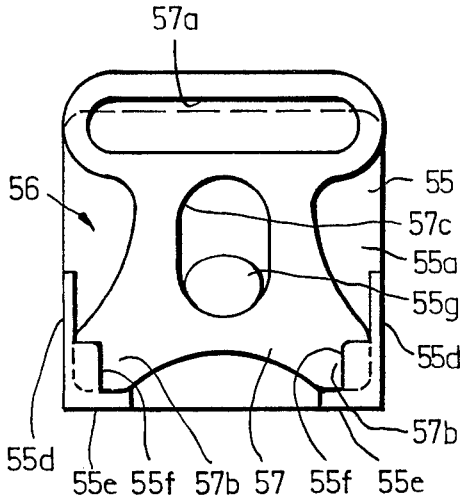
FIG. 10 shows a view of a retaining member shown in FIG. 9 and an elastic member retained in the retaining member.

The two compartments are open towards one another and upwardly and together form a container 56, which is open upwardly over its entire length and in which the rubber-elastic member 57 is held. The member 57 is bounded at the front and at the rear by two planar surfaces, which are parallel to one another and to the longitudinal carrier 51 as well as to the bearing portion 55*a*, and is symmetrical with respect to the vertical longitudinal center plane of the cross-batten. In the proximity of its upper end, the elastic member has a blind hole 57*a*, which is so dimensioned that the end of one cross-batten 54 can be releasably plugged into it and then held therein. The blind hole 57*a* to receive the cross-batten end is preferably disposed at least at the height of the recess engaging portion 55*b* so that the cross-batten 54 is then held a little below the upper edge of the longitudinal carrier 51. As is shown in FIG. 10, the width of the member 57, measured in the longitudinal direction of the longitudinal carrier 51, is approximately equally great in the region of the blind hole 57*a* as the width of the bearing portion 55*a* measured in the same direction. The member 57 displays a constriction underneath the blind hole 57*a*. Furthermore, it is provided with a rounded cavity in the middle at its lower end. The foot part disposed below on the member 57 thus displays two projections 57*b*, which extend away from one another obliquely downwards and each of which projects into a respective one of the two compartments of the retaining member 55. The member 57 is provided approximately in its central region with a passage hole 57*c*, which, at least at the bottom, is round or rounded off and extends parallel to the longitudinal direction of the cross-batten. Into this projects a lug 55*g*, which is contiguous with the bearing portion 55*a* and disposed on the same side of the bearing portion 55*a* as the side portions, bottom portions and back portions. The peripheral surface thereof at the lower side of the lug bears against the surface of the member 57 bounding the passage hole 57*c*. Thereagainst, a free gap is present between the upper side of the lug and the upper part of the boundary surface of the passage hole 57*c*.

To insert the rubber-elastic member 57 into the retaining member 55, the member 57 is pushed from the right in FIG. 9 or possibly obliquely from the top right downwardly with a deformation over the lug 55*g* and simultaneously introduced into the container 56. The projections 57*b* of the support can temporarily be compressed and possibly in addition the side portions 55*d* of the also somewhat elastically deformable retaining member temporarily pressed away from one another. The insertion of the member 57 into the retaining member 55 can also be undertaken when the cross-batten 54 has already previously been plugged into the blind opening 57*a*.

In the assembled state, as shown in FIGS. 9 and 10, the member 57 is held, at its projections 57*b*, underneath by one side edge each of the cross-battens and laterally and below by a side portion 55*d* and a bottom portion 55*e*, respectively. This ensures a firm support of the rubber-elastic member 57 so that it is nowhere sheared off even with large loadings or movements of the cross-batten carried by it. The back portions 55*f* prevent the member 57 being displaced away from the bearing portion 55*a* in the longitudinal direction of the cross-batten 54. The lug 55*g* secures the member 57 against upward displacements. Since a relatively large gap is however present between the upper side of the lug 55*g* and the upper part of the boundary surface of the passage hole 57*c*, the cross-batten can nevertheless spring downwardly. Of course, the member 57 also makes pivotal movements, of the cross-batten around an axis parallel to the longitudinal direction of the latter, possible.

The retaining member 55 consists of a unitary piece of rigidly cross-linked synthetic material and can be manufactured rapidly and simply by a molding process, such as injection-molding. The member 57 can be manufactured from a mixture of natural and synthetic rubber, likewise by a molding process.

Figure 11:
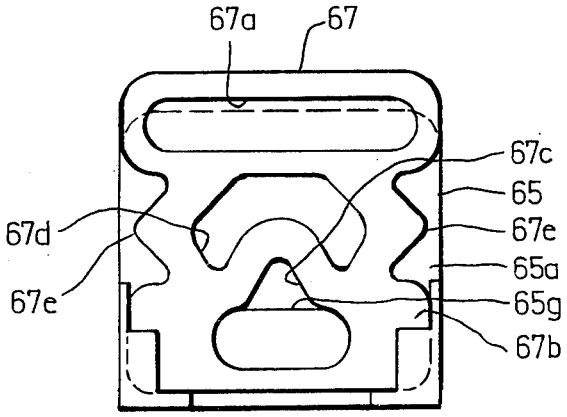
FIG. 11 shows a view, corresponding to FIG. 10, of a further variant of a retaining member and elastic member.

The retaining member 65 of the embodiment shown in FIG. 11 has a bearing portion 65*a*, a not visible connecting member and two side portions, bottom portions and back portions. These are essentially similarly to those of the retaining member 55. A lug 65*g* is situated lower than the lug 55*g* so that it is disposed completely between the side portions of the retaining member. A rubber-elastic support 67 has three main parts, i.e. an upper part with a blind opening 67*a* to receive the cross-batten, a middle part and a foot part. The foot part has two projections 67*b* protruding into the respective compartments formed by each associated side part, bottom part and back part. A passage opening 67*c* extending parallel to the cross-batten (not shown) is situated mostly in the foot part of the member 67, but reaches up into the middle part thereof. The lug 65*g* protrudes into the passage opening 67*c* and bears against the boundary surface thereof below and to both its sides. Thereagainst, the passage opening 67*c* extends further upwardly than the lug 65*g* so that it displays an approximately triangular part remaining free at the top. Present in the middle part of the member 67 is a further passage opening 67*d*, which extends parallel to the cross-batten and which is shaped like a downwardly open sickle. The upper part and the foot part of the member 67 are contiguous in the middle part thereof, to both sides of the opening 67*d* by way of webs 67*e*, the horizontal width of which measured transversely to the longitudinal direction of the cross-battens amounts to at most about 20% of the maximum width of the member 67. The two webs 67*e* are approximately V-shaped, and the V-points are directed away from one another. The webs could also be arcuate instead of V-shaped, in which case the centers of the arcs would be directed away from one another.

When the upper part of the rubber-elastic member 67 is pressed downwardly on a loading of the cross-batten carried by it, the member is at first deformed relatively easily with a splaying of the webs 67*e*. As soon as the material web present between the openings 67*a* and 67*d* touches the web present between the openings 67*c* and 67*d*, the resistance opposed to the deformation becomes substantially greater. The member 67 thus produces a stepped springing, during which the spring constant increases suddenly when the cross-batten is displaced downwardly through a predetermined travel out of its rest position. Apart from this the embodiment shown in FIG. 11 has properties similar to those of the embodiment shown in FIGS. 9 and 10.

Still further variants are possible. For example, the lugs 55*g* or 65*g* of the constructions shown in FIGS. 9, 10 and 11 could be dimensioned to be so long that they completely penetrate the passage openings 57*c* and 67*c*, respectively. Furthermore, it would be possible in this case to replace the back portions contiguous with the side portions by a collar present at the free end of the lug, a Seeger securing ring or an equivalent element, preventing the elastic member sliding away from the bearing portion of the retaining member in the longitudinal direction of the cross-batten. The lug 57*c* or 67*c* could also equally well be hollow. Furthermore, each retaining member could have two or three lugs, which are arranged alongside one another and which project into the same or into different openings of the elastic member.

The cross-section of the recess engaging portion need not be complementary to the recess 1*a* over the entire length of this. The recess engaging portion could, for example, adjacent both sides of the recess have cylindrical spigots bearing against the side surfaces of the recess. The two spigots could possibly be supported against one another by a narrow web in the middle region of the recess.

The side portions could be bent in the lower part or over their entire height as seen in a direction parallel to the longitudinal direction of the cross-batten, instead of being vertical and straight.

As already mentioned, the cross-sectional dimensions of the recesses in the longitudinal carriers are somewhat greater than the cross-sectional dimensions of the cross-battens or at least the ends thereof so that the latter are also pluggable directly into the recesses. This makes it possible to use the same longitudinal carriers of the different types of reclining furniture frames for a non-resilient fastening of the cross-battens. In the case of a non-resilient fastening, a thin-walled sleeve of synthetic material, serving to prevent rubbing noises, can be inserted into each recess and the ends of the battens can be plugged into the sleeves with some play. For this, the Swiss Patent Specification No. 473,559 is referred to, in which this manner of fastening is described.

While specific embodiments of the invention have been shown and described in detail to illustrate the application of the principles of the invention, it will be understood that the invention may be embodied otherwise without departing from such principles.

I claim:

1. A furniture frame comprising:
(a) a pair of laterally spaced relatively elongated carrier members each provided with a plurality of longitudinally spaced recesses,
(b) a plurality of retaining members each having a recess engaging portion located in a respective one of said recesses,
(c) a plurality of cross-battens each extending between a respective pair of said retaining members, and
(d) a respective elastic member detachably retained by each of said retaining members and supporting a cross-batten; each retaining member comprising a bearing portion having two opposite sides, with one side bearing against a respective one of said carrier members, and two side portions and at least one base portion on the other side of said bearing portion, said elastic member being retained by said two side portions, said at least one base portion and at least part of said bearing portion.

2. A frame as claimed in claim 1, wherein said side portions and said base portion are disposed below said recess engaging portion.

3. A frame as claimed in claim 1, wherein each side portion is contiguous with said bearing portion and one said base portion.

4. A frame as claimed in claim 1, wherein said retaining member further comprises at least one back portion spaced from said bearing portion, said elastic member being retained between said back portion and said bearing portion.

5. A frame as claimed in claim 4, wherein said retaining member comprises two back portions each contiguous with a respective one of said side portions and with a respective one of said base portions.

6. A frame as claimed in claim 5, wherein said retaining member comprises two base portions defining a space therebetween, and said two back portions define a further space therebetween.

7. A frame as claimed in claim 1, wherein each recess has a cross-sectional dimension greater than the cross-sectional dimension of end portions of said cross-battens.

8. A frame as claimed in claim 1, wherein each recess has a maximum vertical dimension at most 60% greater than the maximum vertical dimension of said cross-battens.

9. A frame as claimed as in claim 1, wherein said retaining member is of a unitary construction of synthetic material.

10. A frame as claimed in claim 1, wherein each cross-batten has a vertical plane passing through its axis and with respect to which plane said side portions of each respective retaining member are symmetrical, the spacing of said side portions being greater than the width of said cross-batten.

11. A frame as claimed in claim 1, wherein said bearing portion comprises substantially a vertical plate.

12. A furniture frame comprising:
(a) a pair of laterally spaced relatively elongated carrier members each provided with a plurality of longitudinally spaced recesses,
(b) a plurality of retaining members each having a recess engaging portion located in a respective one of said recesses,
(c) a plurality of cross-battens each extending between a respective pair of said retaining members, and
(d) a respective elastic member detachably retained by each of said retaining members; each retaining member comprising a bearing portion having two opposite sides, with one side bearing against a respective one of said carrier members, and two side portions and at least one base portion on the other side of said bearing portion, said elastic member being retained by said two side portions, said at least one base portion and at least part of said bearing portion, said elastic member comprising rubber-elastic material, said retaining member being provided above said side portions and said elastic member with a projection on said other one of said opposite sides of said bearing portion, a non-rubber elastic sleeve being provided having means defining an opening receiving a respective cross-batten end portion, said sleeve comprising two limbs which at least partially encompass said projection, said projection having an upper surface spaced apart from said means defining said opening to permit vertical movement of said sleeve, and said sleeve further being pivotable around said projection.

13. A frame as claimed in claim 12, wherein said limbs of said sleeve are connected to each other by a web portion partially surrounding said projection.

14. A frame as claimed in claim 12, wherein said limbs of said sleeve are connected to each other by a back portion adjacent said other one of said opposite sides of said bearing portion.

15. A furniture frame comprising:
(a) a pair of laterally spaced relatively elongated carrier members each provided with a plurality of longitudinally spaced recesses,
(b) a plurality of retaining members each having a recess engaging portion located in a respective one of said recesses,
(c) a plurality of cross-battens each extending between a respective pair of said retaining members, and
(d) a respective elastic member detachably retained by each of said retaining members; each retaining member comprising a bearing portion having two opposite sides, with one side bearing against a respective one of said carrier members, and two side portions and at least one base portion on the other side of said bearing portion, said elastic member being retained by said two side portions, said at least one base portion and at least part of said bearing portion, said elastic member comprising means defining an opening receiving one end of said respective cross-batten, and further means defining at least one further opening, said retaining member being provided with at least one lug which at least in part penetrates said at least one further opening.

16. A frame as claimed in claim 15, wherein said lug bears against said further means and said lug has an upper side spaced apart from an uppermost region of said further means.

17. A frame as claimed in claim 15, wherein said elastic member further comprises means defining a still further opening extending parallel to said respective cross-batten and situated between said opening and said first mentioned further opening, approximately V-shaped webs, having apices directed away from each other, being situated at both sides of said still further opening.

* * * * *